United States Patent [19]

Röhm

[11] Patent Number: 4,621,445

[45] Date of Patent: Nov. 11, 1986

[54] WEAPON WITH LOCKING TRIGGER

[76] Inventor: Günter H. Röhm,
Heinrich-Röhm-Str. 50, 7927
Sontheim, Fed. Rep. of Germany

[21] Appl. No.: 692,902

[22] Filed: Jan. 18, 1985

[30] Foreign Application Priority Data

Jan. 21, 1984 [DE] Fed. Rep. of Germany ..... 3402006

[51] Int. Cl.[4] ..... F41C 17/04

[52] U.S. Cl. ..... 42/66; 42/70.06

[58] Field of Search ..... 42/66, 70 E

[56] References Cited

U.S. PATENT DOCUMENTS

| | | | |
|---|---|---|---|
| 305,866 | 9/1884 | Tower | 42/66 |
| 469,465 | 2/1892 | Ehbets | 42/66 |
| 814,017 | 3/1906 | Buchanan | 42/66 |
| 2,703,943 | 3/1955 | Roemer | 42/66 |

*Primary Examiner*—Deborah L. Kyle
*Assistant Examiner*—Michael J. Carone
*Attorney, Agent, or Firm*—Karl F. Ross; Herbert Dubno

[57] ABSTRACT

A revolver having a trigger and a hammer which are each pivotally journaled in the weapon frame. When the hammer is brought into its tensioned position, it moves the trigger into the ready-to-fire position in which the trigger arrests the hammer in the tensioned position. For locking the trigger in its rest position when the hammer is in its rest position, a lock part is movably guided directly between the trigger and the hammer. The lock part is in a locking position with respect to the trigger when the hammer and the trigger are in their respective rest positions. When the hammer is moved from its rest position into its tensioned position, the lock part assumes, via associated run-off surfaces, a position permitting pulling of the trigger into the ready-to-fire position. The movement from its tensioned position of the rebounding hammer is effected without interference in sliding manner due to the respective run-off surfaces. The subsequent return of the trigger into its rest position returns the lock part into its locking position.

17 Claims, 5 Drawing Figures

WEAPON WITH LOCKING TRIGGER

FIELD OF THE INVENTION

My present invention relates to a weapon with a safety mechanism or system and, more particularly, to a single-shot weapon, especially a revolver having an improved safety mechanism.

BACKGROUND OF THE INVENTION

A single-shot revolver generally comprises a weapon frame and a barrel, a hammer or cock pivotally mounted on its shaft in the frame, and a trigger also pivotally mounted on its shaft in the frame. The two shafts or axes of rotations, respectively, extend parallel to each other and perpendicular to the barrel axis.

The hammer can be pivoted or swung from its rest or first position, against the force of a hammer spring, into a second position in which it is held under tension, or is tensioned or cocked by the hammer spring.

The hammer actuates a striker or firing pin, and movement of the hammer urges the trigger to swing from its rest or first position, against the force of the respective trigger spring, into a second position corresponding to the ready-for-firing condition of the weapon. When it is in this condition, the trigger precludes movement of the hammer, and the hammer or cock is maintained in its tensioned position or cocked. In other words, the trigger is set for firing when the weapon has been cocked.

The weapon also includes a cylinder with several cartridge chambers. This cylinder is mounted in the frame so that it can rotate about its shaft axis which extends parallel with respect to the barrel axis. A detent latch holds the cylinder in its positions. The detent latch engages cylinder catches arranged exteriorly at the cylinder, and the cylinder, accordingly, is capable of being indexed, i.e. of being stepped to bring succeeding cartridge chambers in line with the barrel.

A trigger bar or rod is kinematically connected or linked to the trigger, and when the trigger is pulled for firing, the trigger bar is moved or shifted in substantially longitudinal direction in the weapon frame. The upper free end of the trigger bar is positioned between the firing pin and the hammer when the trigger has assumed the ready-to-fire position. The rebounding hammer moves the striker by way of the free end of the trigger bar in axial direction causing firing of the weapon. At the end of the rebounding movement, the hammer is in its rest or first position.

The weapon also includes a lock which prevents pulling of the trigger when the hammer is in its rest position. This lock includes a lock part which is operative between the trigger and the ahmmer. The lock part can assume a locking or first position when the trigger and the hammer are in their respective rest positions, and movement of the trigger is then blocked. The lock part releases or frees the trigger during movement of the hammer from its rest or first position into the cocked or tensioned position (second position). Accordingly, the trigger can then be moved or swung into the ready-to-fire or second position, and the lock part leaves its locking or first position. When the hammer has returned to its first or rest position, the lock part also returns to its locking or first position during swinging back of the trigger from the ready-to-fire position into its rest or first position, and the trigger is blocked again by the lock part.

U.S. Pat. No. 3,777,384 describes a safety mechanism of this type for a revolver with a drum. The lock part in the prior art revolver is formed by the trigger bar. When the trigger of this prior art revolver is in its rest position, the trigger bar contacts a detent projection or formation of the hammer and, accordingly, movement or swinging of the trigger into the ready-to-fire (firing readiness) position is prevented. The trigger bar also engages in the detent projection, either with a corresponding detent projection or formation, or with the smooth frontal face of its free end. Moving the hammer into the tensioned position causes the hammer detent projection to be placed such that it is out of the reach of the trigger rod, i.e. the free end thereof. The trigger bar is then free to reciprocatingly move in its longitudinal direction. Accordingly, the trigger can then be swung to assume the second or ready-to-fire position.

Independently of the particular configuration of the trigger bar, the detent projection at the hammer must, in any case, be provided at the end which is remove from its pivot or swing axis. This is due to the fact that only at this free end can reliably occur (a) the detent engagement of the trigger bar in the detent projection, especially after firing a shot, on the one hand, and (b) disengagement of the detent projection during tensioning of the hammer, on the other hand.

Accordingly, the lock which ensures the safety function is provided in that part of the weapon in which the transfer of force or forces from the hammer to the firing pin arises. In this region the cartridges are fired and gases are formed which can contaminate and detrimentally affect the operation of the weapon. This region of the weapon, furthermore, and at least when the hammer is in the tensioned or cocked position (second position), is freely accessible.

Accordingly, during handling of the weapon, for example when changing cartridges, this region is very likely to become soiled and gather dust and dirt on the one hand and can be so manipulated that the intended locking function or effect, either unintentionally, for example when dirt accumulates at the detent projection, or even intentionally will fail. The safety of the weapon in either case would be noticeably and detrimentally affected.

OBJECTS OF THE INVENTION

It is therefore a primary object of my invention to provide a revolver which substantially precludes the disadvantages of the prior art.

It is also an object of my invention to provide a safety mechanism or system of the type briefly described in which the lock part is directly operative between the trigger and the hammer, i.e. it engages in parts or components which are directly facing each other.

It is also an object of the invention to provide a revolver which has enhanced safety features.

It is further an object of the invention to provide a safety mechanism which is operative independently of respective possible operational conditions or positions.

It is still further an object of my invention to provide a revolver which is substantially safe to handle even when handled in an improper manner.

SUMMARY OF THE INVENTION

These objects are attained in accordance with the invention in that the lock part is movably guided in the trigger and that it has at least one surface which projects a predetermined distance from the trigger. This projecting surface forms a first cam surface or run-off surface and this can contact the hammer at the associated hammer cam surface or second run-off surface, subject to the force of a lock spring. Accordingly, the lock part cam surface and the hammer cam or run-off surface are in close association near each other.

A catch recess or similar opening and a catch hook are provided near the cam surface of the hammer, and the leading and/or precursing edge of the hook presents a cam surface adapted to cooperate with a cam surface at the upper trigger end. In general terms, the one side of the catch recess, accordingly, forms a portion of the run-off surface of the hammer. In this region the cam surface at the lower hammer end also includes a cam projection, formation or surface which can move the lock part out of its locking position.

When both the trigger and the hammer are in their respective rest or first positions, the lock part enters into the hitherto unoccupied catch recess and, accordingly, the lock part includes a projection which extends generally at the frontal or forward surface, i.e. the first cam surface, and laterally in the direction towards the catch hook. The projection is also able to enter and fit into the catch recess.

It is also preferred that the clear distance between the free end of the catch hook and the juxtaposed or facing edge of the catch recess be smaller than the width of the run-off surface at the lock part when measured in the same direction.

Accordingly, the hammer rebounding from its tensioned position runs off slidingly via its own run-off surface and the run-off surface at the lock part. Accordingly, the lock part is held without locking action at the hammer in a substantially neutral position.

The advance achieved by my invention largely derives from the fact that the lock part is arranged interiorly with respect to the weapon frame. Accordingly, during use of the weapon, the lock part can not be affected by moving parts, i.e. by such parts which are either removable and/or movable. Furthermore the lock part is protected or shielded against entry of dust and other dirt, and it will also not be subjected to manipulations or undue abuse which can be performed from the exterior. Accordingly, the safety of the weapon is substantially increased.

A preferred embodiment of the invention contemplates that the lock part is a pin or short rod, and that the projection of the lock part is an annular shoulder or similar projecting formation. The rotational attitude during installation or assembly is then immaterial.

It is also preferred that the pin is substantially shaped like a bushing or similar hollow cylindrical member. This is interiorly furnished with a helical coil spring which, in turn, forms the lock spring.

In accordance with another preferred embodiment, the catch recess exhibits a planar recess bottom which is inclined with respect to the second run-off surface. The planar forward or frontal surface of the lock part rests on the recess bottom in a planar manner at least when the hammer and the trigger are in their respective rest positions.

BRIEF DESCRIPTION OF THE DRAWING

The above and other objects, features and advantages will become apparent from the following description, reference being made to the accompanying drawing, in which.

SPECIFIC DESCRIPTION

Figure 1:
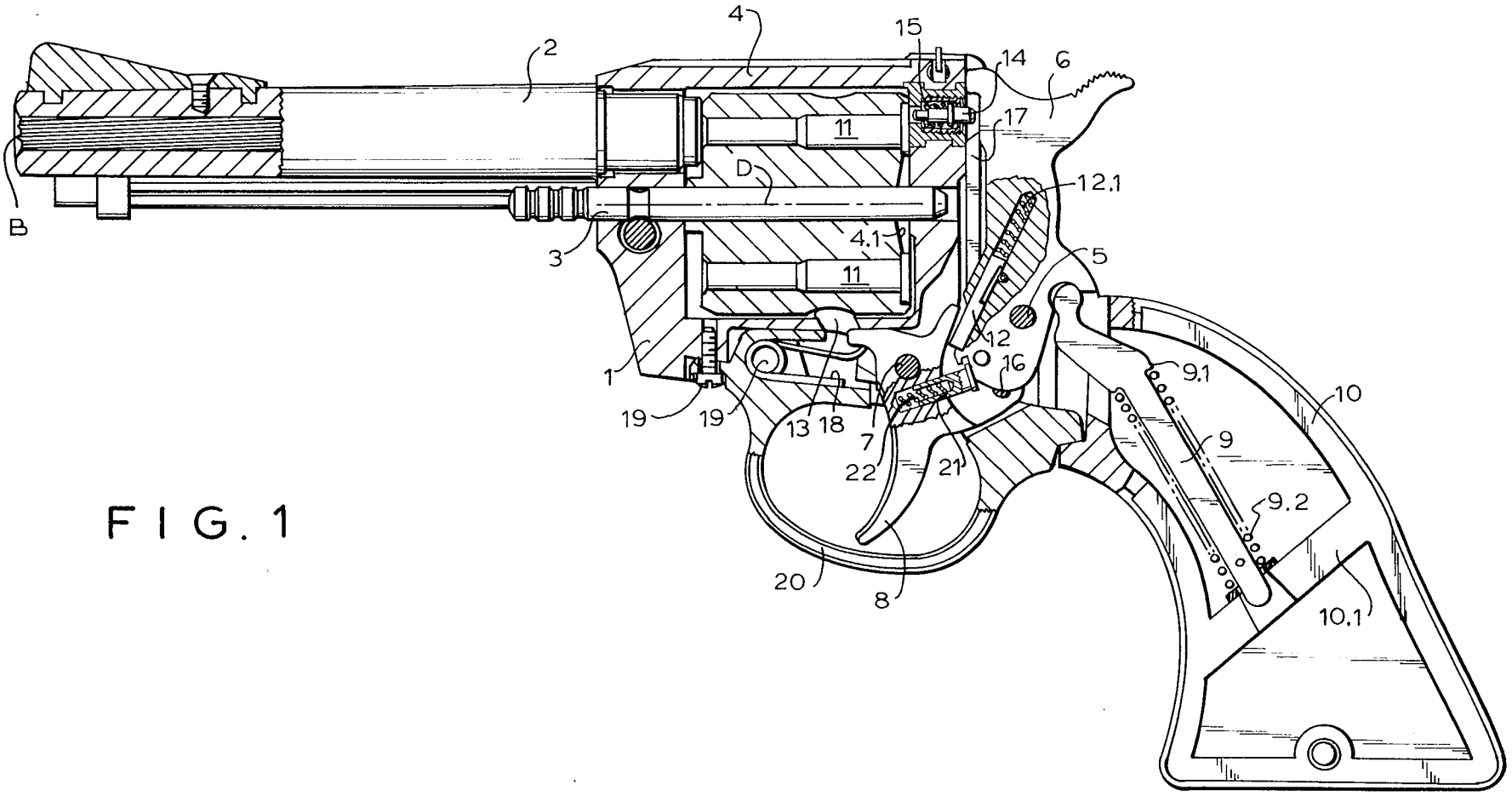
FIG. 1 is a side elevation with some parts broken away of a revolver with a safety system in accordance with the invention.

The safety mechanism shown in the drawing is particularly intended for single-shot or single firing weapons, for example revolvers, other handguns, and the like small hand-held weapons. FIG. 1 shows a revolver, i.e. a handgun with a cylinder of several chambers which can be successively brought into line with the barrel and discharged with the same hammer.

The revolver basically includes a weapon frame with the associated barrel 2 connected thereto. The revolver also includes a cylinder 4 which is mounted on the frame 1 so that it can rotate or revolve about the shaft or axle 3, and the central and longitudinal axis D of the axle serves as the axis of rotation for the cylinder 4.

A hammer or cock 6 is also mounted in the frame 1, and swings on its axle or shaft 5. The revolver further includes a trigger 8 which can be pivoted, swung, or rotated about the respective axis of rotation provided by a trigger shaft 7.

The revolver also includes a cocking mechanism 9 for the cock or hammer 6. This mechanism 9 includes a fulcrum arm or end 9.1 in the handle or grip 10, and a spring 9.2 for tensing or tensioning of the mechanism 9 is disposed with its helical coils about the fulcrum end 9.1 in the handle or grip 10. The fulcrum end 9.1 is secured with its lower end to a strut 10.1 of the grip 10 which is connected to the frame 1.

Figure 3:
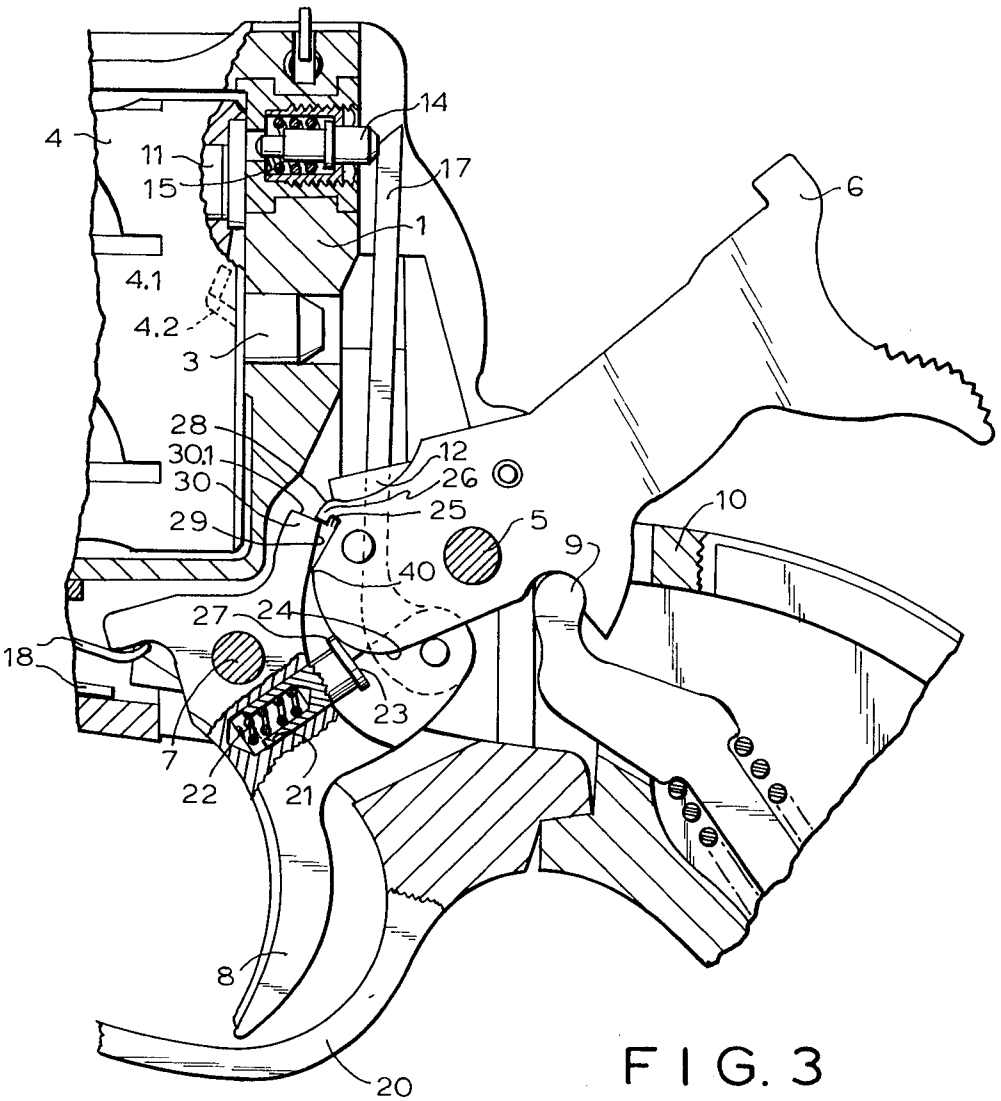
FIG. 3 is a view similar to FIG. 2 with the hammer in stressed or cocked position.

The cylinder 4 is furnished with several cartridge chambers 11 which can be successively brought into line with the bore B of the barrel 2 by rotating or revolving the cylinder 4 about its axis of rotation D. Transport or rotation of the cylinder 4 is affected by a transport latch 4.2 which is schematically indicated in FIG. 3, together with a cooperating ring gear 4.1 or the like which is disposed at the rearwardly disposed face of the cylinder 4 and cooperates with a pawl for stepping the cylinder.

A control bar or rod 12 is arranged at the hammer 6. The control bar 12 initiates advancing, transporting, or rotation of the cylinder 4, by actuating a detent latch 13, FIG. 1 which temporarily releases a respective drum catch 13, and the cylinder 4 can turn during such release. The control rod 12 is held under tension by a spring 12.1.

Furthermore, a firing pin or striker pin 14 is arranged for axial and longitudinal movement in the frame 1. When the revolver is fired, the striker pin 14 is axially shifted, against the action of the compression spring 15, to strike a cartridge loaded in the uppermost cartridge chamber 11 of the cylinder 4. To effect firing or discharge of the weapon, a longitudinal trigger bar 17 is linked to a pivot or pivot shaft at 16 to the trigger 8. The trigger bar 17 extends generally between the frame 1 and the hammer 6. In response to movements of the trigger 8, the trigger bar 17 is moved in the vertical longitudinal direction. The trigger bar 17 includes an inclined surface, end formation or terminus 17.1 (FIG. 2) which can be brought between the striker pin 14 and the hammer 8, see FIGS. 3 to 5.

On pulling the trigger 8 for firing, the rebounding hammer 6, via the trigger bar 17, shifts the strike pin 14 in the direction of the cartridge chamber 11.

The trigger is returned to its rest or first position by way of a trigger spring 18 which, for example is a coil spring with extended ends or legs. The spring 18 is arranged in a recess in the weapon frame 1, i.e. specifically in the trigger guard 20, see FIG. 1.

A lock part 21 is interiorly equipped with a lock spring 22 and the lock part 21 prevents actuation of the trigger 8 when the hammer 6 is in its rest or first position.

The lock part 21 is movably guided in the trigger 8, but is subject to the force of a lock spring 22. The lock part 21 has a surface 23 which projects from the trigger 8, because the lock part extends in the trigger 8 and also extends somewhat out of the trigger 8. This projecting surface provides a run-off surface or cam surface 23 which can contact the hammer 6 in the region of a second run-off surface or cam surface 24, subject to the force of the lock spring 22. This second run-off surface 24 at the hammer 6 is associated with the first run-off surface 23 in such a way that contact between these two is easily achieved.

The hammer 6 presents a complex structure or configuration at its lower end, i.e. the end generally disposed beneath the pivot or shaft 5. This end includes the rounded run-off surface 24, generally directed towards the grip 10, the lower end also includes a recess bottom 25.1 (FIG. 5), and a cam formation, projection or surface 40 is provided between the rounded run-off surface 24 and the recess bottom 25.1. A catch recess 25 follows the recess bottom in the direction towards the cylinder 4. The leading or precursing edge of the lower hammer end, i.e. that edge or surface which is generally directed towards the cylinder 4, is adapted to act at or presents a catch hook 26 which catch hook is open at least during swinging of the hammer 6 into the tensioned position (second position). The hammer spring is provided by the spring 9.1.

The catch hook 26 is intended, to cooperate with the lock part 21 and can engage with a lateral projection 27 at the end of the lock part which projects from the trigger 8, i.e. the end with the run-off surface 23. Accordingly, the lateral or annular projection 27 can be introduced into the catch recess 25.

The leading end of the catch hook 26 presents a cam formation, surface or formation 28.

Figure 5:
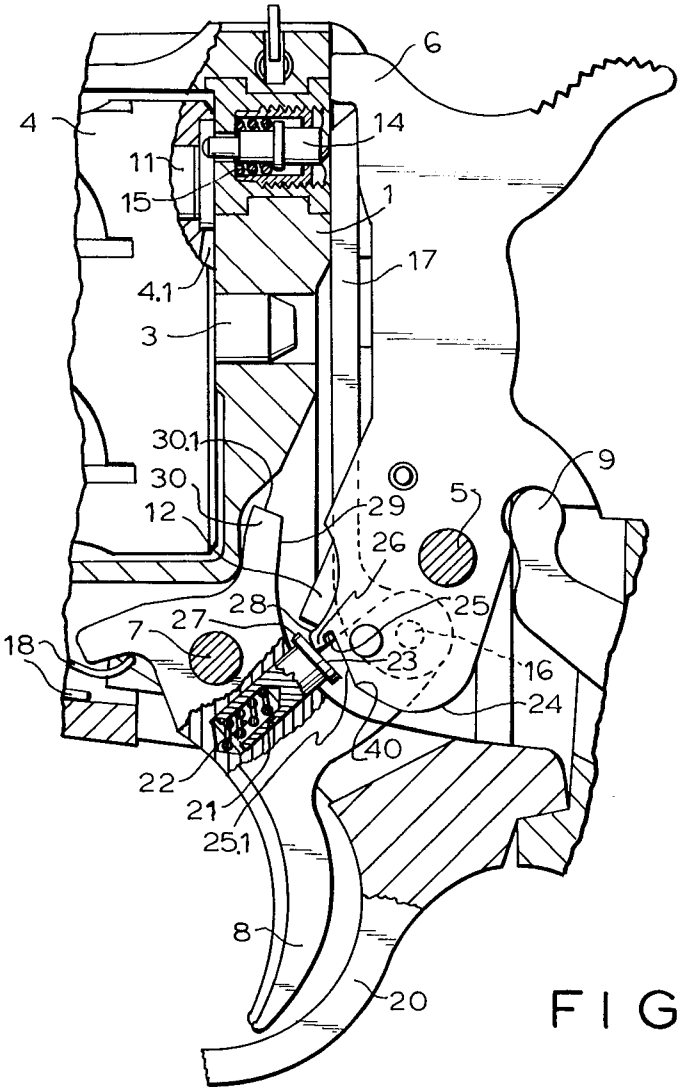
FIG. 5 is a view similar to FIG. 2 with the hammer fully returned to the rest position and the trigger still in the pulled position.
Figure 4:
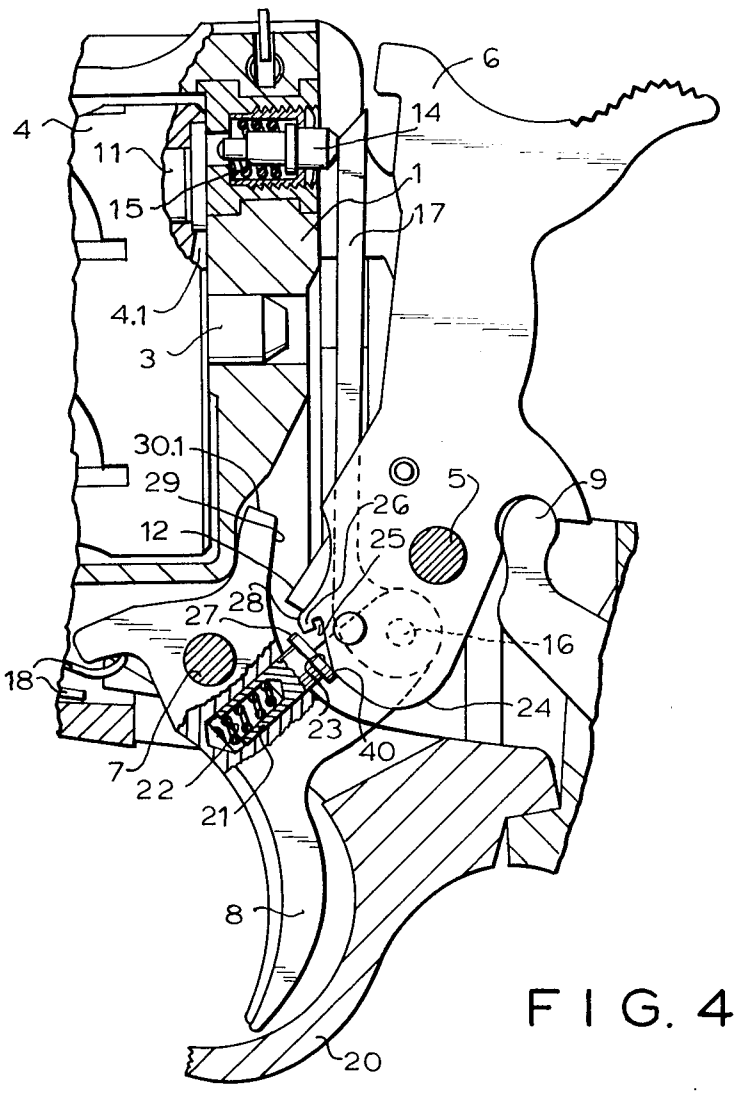
FIG. 4 is a view similar to FIG. 2 with the hammer almost returned to the rest position.

When the trigger 8 is in the ready-to-fire position, shown in FIGS. 3 to 5, the run-off surface 23 of the lock part 21 is substantially tangentially disposed on the run-off surface 24 of the rebounding hammer 6, at least in the vicinity of the catch recess 25.

Figure 2:
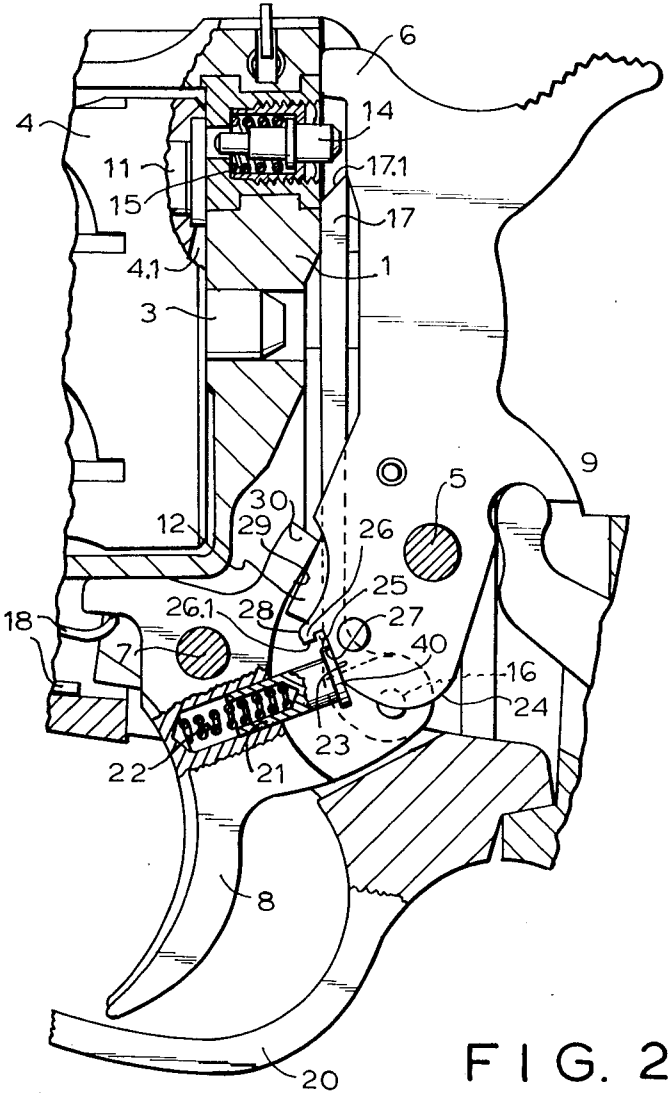
FIG. 2 is a side elevation drawn to a larger scale and showing the relationship between the trigger, the hammer and associated components at the grip with the hammer in rest position.

When the trigger 8 is in its rest or first position, the run-off surface 23 of the lock part 21 extends in a skewed or inclined manner with respect to the run-off surface 24 of the hammer 6, as is indicated in FIG. 2. Accordingly, the lock part 21 extends by the projection 27 into the catch recess 25. This will be the case when both the trigger 8 and the hammer 6 are in their respective rest positions.

The clear distance of separation between the free end of the catch hook 26 and the juxtaposed or facing edge of the catch recess 25 is then smaller than the width of the run-off surface 23 at the lock part 21 when measured in the same direction. Accordingly, when rebounding from its tensioned or second position the hammer 6, as it were, slides or engages in a sliding manner via its own run-off surface 24 along the run-off surface 23 at the lock part 21. The lock part 21 is, accordingly, held without locking action at the hammer 6 in a substantially neutral position.

The lock part 21 can be embodied by a pin or short rod, and the projection 27 can be an annular shoulder or similar projecting formation.

Furthermore, the pin or short rod can be in the form of a bushing or similar hollow cylindrical member. A helical coil spring 22 can be mounted in the hollow interior of the member after introduction thereof through the open end of the member.

The catch recess 25 has a planar recess bottom 25.1 and the edge thereof which is facing away from the catch hook 26 forms a cam projection, formation or surface 40 where it merges into the run-off surface 24, as has been mentioned.

The initial position of the weapon is shown in FIGS. 1 and 2. In this position and when the trigger 8 is pulled, the projection 27 of the lock part 21 is moved beneath the catch hook 26 of the catch recess 25. This will preclude a further movement or motion of the trigger 8 and especially cocking or tensioning of the hammer 6 by way of the trigger 8.

On the other hand, when the hammer 6 is brought from its rest or first position, as is shown in FIG. 2, into the pivoted or second position, i.e. swung clockwise about the pivot axis provided by the central axis of shaft 5, as is indicated in FIG. 3, the lock part 21 is moved by the cam projection 40 of the lower end of hammer 6 by being pushed depper into the trigger 8 against the force of the spring 22. The lock part 21 subsequently contacts or rests on the run-off surface 24 of the hammer 6.

On swinging or pivoting the hammer 6 into the tensioned or second position, the trigger 8 is brought from its rest position (first position) into the ready-to-fire or second position. For this, the nose or similar cam formation or projection 28 of the hammer 6 engages or contacts at the respective trigger cam formation 29 at the trigger end or formation 30, i.e. the trigger end which extends generally above the central horizontal axis of the trigger shaft 7 of the trigger 8. Accordingly, the nose 28 slides along the trigger cam formation 29 which is generally directed towards the handle 10.

The free end or surface of the catch hook 26 simultaneously serves as a cam detent, rest or stop for the trigger end or cam formation 30 which is provided at the upper end of the trigger cam end 29. This end 30 engages, subject to the force of the trigger spring 18 the free end, rest or stop of catch hook 26. In other words, the surface 26.1 (FIG. 2) of the catch hook 26, rests on the surface 30.1 (FIG. 3) of the upper trigger end 30. Accordingly, the hammer 6 is then maintained in the tensioned, second or cocked position, see FIG. 3.

When the trigger 8 is pulled while the hammer 6 is in the cocked position, as is represented in FIG. 3, the trigger end 30 is released from the free end, rest or stop of catch hook 26, and the hammer 6 can rebound into its rest position (first position), as is represented in FIGS. 4 and 5.

Because the trigger 8 does not return to its rest position when the hammer 6 moves forward, i.e. into its rest or first position, the run-off surfaces 23 and 24 of the hammer 6 and the lock part 21, respectively, contact one another in tangent or tangential manner, whereby the surface 24 slidingly moves on the surface 23. Accordingly, the lock part 21 can not enter into the catch recess 25 with the formation 27 because of (the smaller clear entry width) due to the relative dimensions of the respective components, as is shown in FIG. 4.

Because the trigger rod or bar 17 enters between the hammer 6 and the striker pin 14, when the trigger 8 is pulled, in accordance with FIG. 5, the rebounding hammer 6 shifts the striker pin 14 in horizontal axial direction towards the cartridge chamber 11. When the trigger 8 is released, the run-off surface 23 of the lock part 21 glides exteriorly down at the catch hook 26, see FIG. 5 due to the urging of the spring 18 and, subsequently, enters again into the catch recess 25 by way of the projection 27. The weapon is then again in the initial or starting position as shown in FIG. 2.

I claim:

1. A revolver comprising:

a weapon frame including a grip for holding the revolver;

a barrel mounted on said frame;

a trigger mounted in said frame on a respective trigger shaft near said grip and in association with a respective trigger spring, said trigger being adapted to be pivoted about a respective axis of rotation of said trigger shaft against the force of said trigger spring at least from a first position which corresponds to its rest position into a second position corresponding to a ready-to-fire condition of said revolver;

a hammer mounted in said frame on a respective hammer shaft near said grip and in association with a respective hammer spring, said hammer being adapted to be pivoted and swung about an axis of rotation of said hammer shaft against the force of said hammer spring at least from a first position corresponding to its rest position, into a second position in which it is held against the tension of said hammer spring, and being adapted to rebound from said second position into said first position, whereby movement of said hammer into said second position allows movement of said trigger into its second position, and whereby said trigger in its second position substantially precludes movement of said hammer when it is in said second position, said hammer shaft extending substantially parallel with respect to said trigger shaft, said hammer including at least one first cam surface allowing sliding contact, and a catch hook with an associated catch recess near said cam surface, said catch hook including at least one leading and precursing edge, said edge being formed to present a cam formation (28); said catch recess being unoccupied at least when said hammer is swung into its second position, and said catch recess being adapted to form at least a portion of said cam surface, and a cam projection (40) positioned at said cam surface and said catch recess, said cam projection being adapted to be swung with said hammer;

a cylinder having a plurality of cartridge chambers and a plurality of cylinder catches, said cylinder being mounted in said frame between said barrel and said grip on a respective cylinder shaft, said cylinder shaft extending substantially parallel to said barrel;

a detent latch adapted to engage and disengage in a sequential manner at least one of said cylinder catches, whereby rotation of said cylinder with respect to the respective axis of rotation of said cylinder shaft is precluded when said detent latch engages a respective cylinder catch and rotation of said drum is allowed when said detent latch is disengaged from the respective cylinder catch;

a striker pin mounted in said frame adjacent the respective grip side of said drum and in association with a striker pin spring, said striker pin being at least capable to be aligned with a respective loaded cartridge chamber in said cylinder;

a longitudinal trigger bar, said trigger bar being mounted so as to be moved in the direction of its longitudinal axis and substantially perpendicularly with respect to axis of rotation of said cylinder, said trigger bar having a first end which is kinematically linked to said trigger, and an upper second end, said upper trigger bar end being adapted to be disposed between said striker pin and said hammer when said trigger has assumed said ready-to-fire position whereby said hammer during its rebounding movement from said second position into said first position moves said striker pin in axial direction by way of the said upper trigger bar end, for firing of the weapon;

a lock, said lock substantially preventing pulling of said trigger when said hammer is in its first position, said lock including a lock part which is directly operative between said trigger and said hammer, said lock part being adapted to assume a first position in which it is substantially at rest and precludes pulling of said trigger as aforesaid when said trigger is in its first position and said hammer is in its first position, said lock part being positioned, at least during movement of said hammer from its first position into its second position, to release said trigger, whereby said trigger can be moved freely into said ready-to-fire position and said lock part leaves its first position to assume a second position, said lock part also being positioned to return to its first position when said hammer has returned to its first position, but allowing swinging back of said trigger from said ready-to-fire position into its first position, whereby said trigger is locked again by said lock part;

said lock part being movably guided in said trigger, and including a first surface adapted to project a predetermined distance from said trigger, said first surface forming a cam surface allowing sliding contact, and a lateral projection adapted in size to said catch recess of said hammer, whereby said lateral projection can effectively enter into said catch recess when said trigger is in its first position and said hammer is in its first position, and whereby said hammer on returning from its second position into its first position slidingly contacts with its cam surface said cam surface of said lock part, and whereby said lock part is held without locking action at said hammer; and a lock spring mounted at said lock part in such a way so as to urge said first surface of said lock part to project said predetermined distance from said trigger, whereby said first surface of said lock part contacts said hammer at least on said first cam surface of said hammer, but subject to the force of said lock spring, whereby said first cam surface of said hammer and said first surface of said lock part are arranged in cooperating relation with respect to each other.

2. The weapon according to claim 1 wherein said lateral projection of said lock part is adapted in size to said catch recess of said hammer in such a way that the clear distance between a free end of said catch hook and an edge of said catch recess is smaller than the width of said lateral projection of said lock part when measured in the same direction and when said hammer is in its first position and said trigger is in its first position and said lateral projection is engaged in said catch recess.

3. The weapon according to claim 1 wherein said lateral projection is annular.

4. The weapon according to claim 1 wherein said lock part includes a bushing having at least one closed end and at least one open end, and wherein said lock spring is a helical coil spring adapted to be introduced into said bushing through said open end and to be retained near said at least one closing bushing end.

5. The weapon according to claim 1 wherein said catch recess has a substantially planar recess bottom, and wherein said first surface of said lock part abuts in planar manner on said recess bottom at least when said hammer is in its first position and said trigger is in its first position.

6. The weapon according to claim 1 wherein said catch recess bottom can be positioned in an inclined manner.

7. The weapon according to claim 1 wherein said at least one first cam surface of said hammer is curved with respect to said cam surface of said lock part for allowing sliding contact.

8. The weapon according to claim 1 wherein said trigger has an upper trigger end including a cam formation, said cam formation being adapted to be contacted at least by a forward end of said catch hook.

9. The weapon according to claim 8 wherein said upper trigger end includes a surface which provides at least a temporary stop.

10. The weapon according to claim 9 further comprises a planar surface for said catch hook, said planar surface being positioned in such a way so as to contact said upper trigger end surface for provision of a respective temporary stop.

11. The weapon according to claim 8 further comprising a control bar or rod adapted to engage said cam formation of said upper trigger end.

12. The weapon according to claim 11, further comprising a spring for said control rod, said spring being mounted interiorly in said hammer.

13. The weapon according to claim 11, further comprising a support member mounted in said grip for said hammer spring.

14. In a safety device for a weapon with a weapon frame (1) forming parallel axis (5 and 7) for pivotally journaling a trigger (8) and hammer (6) which actuates a striker pin (14) the hammer (6) being adjustable and movable against the force of a hammer spring (9.1) from its rest first position into a tensioned cocked or second position to thereby move a trigger (8) against the force of a trigger spring (18) from the rest position into a ready-to-fire or second position in which the trigger (8) arrests the hammer (6) in the tensioned position, wherein a trigger bar is kinematically linked to the trigger and by actuation of the trigger an upper free end of the trigger bar is positioned between the striker pin and the hammer when the trigger has assumed the ready-to-fire position, so that the rebounding hammer moves the striker pin by way of the free end of the trigger bar in an axial direction the safety device including a lock part which is operative between the trigger and the hammer, which lock part can assume a locking or first position when the trigger and the hammer are in their respective rest positions, for precluding movement of the trigger the lock part furthermore during movement of the hammer from the rest position into the cocked position releases the trigger so that it can be moved or swung into the ready-to-fire position, whereby the lock part leaves its locking or first position; and that finally, when the hammer has returned to its first or rest position, the lock part also returns to its locking or first position during swinging back of the trigger from the ready-to-fire position into its rest or first position, so that the trigger is locked, the improvement wherein: the lock part (21) is movably guided in the trigger (8) said lock part (21) having a projecting surface which is urged by a lock spring (22) against the hammer, and within a run-off first surface (24) defined by the hammer (6) engageable with the projecting surface (27), a catch recess (25) is provided and has a leading edge capable of acting as a catch hook (26) during swinging of the hammer into a tensioned position, whereby an outer side of the catch hook (26) forms a portion of the run-off first surface (24) and an edge of the catch recess (25), which edge merges with the run-off first surface (24), and forms a cam projection (40) which can move the lock part (21) out of its locking position; and wherein the lock part (21), when both the trigger (8) and the hammer (6) are in rest position, enters into the catch recess (25) whereby a lock part (21) frontal face side has a laterally projecting projection (27) and whereby a clear distance between the free end of the catch hook (26) and a juxtaposed edge of the catch recess (25) is smaller than the same direction measured width of a run-off second surface (23) defined by the lock part (21), so that the run-off first surface of the hammer (6) rebounding from its tensioned position runs off slidingly over the run-off second surface (23) at the lock part (21) and an outer side of the catch hook thereby holds the lock part (21) without locking action at the hammer (6).

15. The improvement defined in claim 14 wherein the lock part (21) is a pin and that the frontal projection (27). of the lock part (21) is formed as an annular shoulder.

16. The improvement defined in claim 15 wherein the pin is shaped like a bushing and interiorly is furnished with a helical coil spring which forms the lock spring (22).

17. The improvement defined in claim 16 wherein the catch recess (25) exhibits a planar recess bottom which is inclined with respect to the run-off surface (24), at which a planar-formed frontal surface of the lock part (21) abuts flat when the hammer (6) and the cock (8) are in rest position.

* * * * *